United States Patent [19]

Goerner et al.

[11] 4,422,566

[45] Dec. 27, 1983

[54] ARRANGEMENT FOR GUIDING PRINT WEBS ON CYLINDERS OF ROTARY PRINTING MACHINES

[75] Inventors: Klaus Goerner; Manfred Dietze; Rainer Birkner, all of Leipzig, German Democratic Rep.

[73] Assignee: VEB Kombinat Polygraph "Werner Lamberz", Leipzig, German Democratic Rep.

[21] Appl. No.: 263,466

[22] Filed: May 13, 1981

[30] Foreign Application Priority Data

May 13, 1980 [DD] German Democratic Rep. ... 221059

[51] Int. Cl.[3] ..... B65H 17/20

[52] U.S. Cl. ..... 226/191; 226/75

[58] Field of Search ..... 226/181, 182, 186, 187, 226/190, 191, 193, 175, 52, 58, 95, 97, 75, 81; 101/228–232, 142; 271/51

[56] References Cited

U.S. PATENT DOCUMENTS

| | | | |
|---|---|---|---|
| 1,724,120 | 8/1929 | Wiswall | 226/58 X |
| 1,898,141 | 2/1933 | Piper | 226/81 |
| 3,252,640 | 5/1966 | Huck | 226/175 |
| 3,323,794 | 6/1967 | Brandt | 271/51 |
| 3,342,129 | 9/1967 | Weigl | 101/142 |
| 3,587,962 | 6/1971 | Herzhoff et al. | 226/95 |
| 4,236,659 | 12/1980 | Edwards | 226/58 |

*Primary Examiner*—Leonard D. Christian

*Attorney, Agent, or Firm*—Michael J. Striker

[57] ABSTRACT

An arrangement for guiding and holding a print web moving between cylinders of a rotary printing machine has an element for preventing slippage of the web between the cylinders, located in a passage of one of the cylinders and extending at least to the outer surface of the latter so as to cooperate with the print web.

15 Claims, 8 Drawing Figures

ARRANGEMENT FOR GUIDING PRINT WEBS ON CYLINDERS OF ROTARY PRINTING MACHINES

BACKGROUND OF THE INVENTION

The present invention relates to an arrangement for guiding and holding of print webs on rubber cylinders of rotary printing machines.

During operation of a rotary printing machine different tension conditions take place before, between and after the printing mechanisms which result in existence of a pressure differential at a respective one of the printing mechanisms. For avoiding the adjustment of the web tension differences before, between and after the printing mechanism during the printing process, or in other words for avoiding the adjustment of the pressure differential existing at each printing mechanism, it is known to offset the functionally cooperating rubber cylinders relative to one another by an angle corresponding to the particular conditions. In such a construction the print web is located so that it forms a greater or smaller angle of contact $\phi$ of the web on the cylinder, whereby a friction force is generated between the print web and the cylinder. Thereby, when a throughgoing passage is formed corresponding to the time of mutual alignment of two passages in two cylinders rolling over one another, a web slippage and thereby irregularities on the print are eliminated.

The angle of offset of both rubber cylinders can not be adjusted in a maximum manner, because of existing structural conditions in the printing machine, for example because the dimensions of functional groups of the machine are kept in relatively narrow limits for their adjustment in correspondence with the respective conditions. The angle of offset of both rubber cylinders cannot also be adjusted in maximum manner because of special printing phenomena, for example very high adhesion of the web on the respective rubber cylinders and thereby its uncontrollable excessive elongation. Because of the above-mentioned limits of adjustability of the angle of offset, the value of the friction force and its action also takes place within narrow limits. When the limit web tension difference absorbed by this friction force is exceeded, slippage of the print web in the zone of the throughgoing passage takes place and leads to reduction of the print quality.

The patent of the German Democratic Republic No. 431,259 discloses an arrangement for mounting the rubber fabric on the transmission cylinder of a rotary printing machine, which has technical means arranged in the passage on the cylinder and having a cover rod which is provided with a rubber coating and has a radius approximating to the radius of the cylinder, the cover rod constituted by a tension rod forming a functional unit. The mounting of the tension rod as well as of the cover rod is connected with great expense. After the insertion of the cover rod, the entire rubber cylinder including the rod must be cylindrically ground. When it is necessary to provide a post-tensioning of the rubber fabric, very expensive dismounting of the tensioning units accommodated in the cylinder passage and subsequent mounting must be performed. The insertion depth of the tension rod and the cover rod can change and a web slippage can take place, whereby the grinding process must be again repeated, so that a post-tensioning of the rubber fabric on the rubber cylinder which is built in the printing mechanism is not possible.

SUMMARY OF THE INVENTION

Accordingly, it is an object of the present invention to provide an arrangement for guiding and holding a print web in a rotary printing machine, which avoids the disadvantages of the prior art.

More particularly, it is an object of the present invention to provide an arrangement for guiding and holding a print web which prevents slippage between two rubber cylinders rolling one over the other and thereby prevents fluctuations of the printing conditions which undesirably affect the quality of printing.

It is an object of the present invention to provide such an arrangement which prevents the adjustment of the web tension difference during the printing process at each printing mechanism, particularly at each rubber cylinder pair, also in condition of formation of a throughgoing passage. This is performed in such a manner that the process of tensioning of the rubber fabric on the individual cylinders is not complicated and undesirably affected, and the rubber cylinders must not be adjusted in their radial position relative to one another.

In keeping with these objects and with others which will become apparent hereinafter, one feature of the present invention resides in an arrangement for guiding and holding a print web moving between cylinders of a rotary printing machine, wherein at least one of the cylinders has at least one passage which is open at the outer surface of the cylinder, and at least one slippage preventing element which is located in the passage of the cylinder and extends to at least the outer surface of the latter so as to cooperate with the web.

The above-mentioned element may cooperate with the web in engaging and force-transmitting manner, may guide and/or hold the web during its movement, may be adjustable in direction towards the outer surface of the cylinder and thereby toward the web, and may extend outwardly beyond the outer surface of the cylinder. A plurality of such elements may be located in a plurality of passages provided in the one cylinder. Identical passages and elements may also be provided in the other cylinder which cooperates with the first-mentioned cylinder.

The slippage preventing element may be formed as a needle. A sleeve may surround the needle and be spring-biased in the direction of elongation of the needle. It is advantageous when the needle is controllable in a rhythmic manner, particularly with respect to the starting point of its operation. The controlling means may be electromagnetically operating or formed as a cam element.

When the arrangement is designed in accordance with the present invention, it is guaranteed that the elongation conditions of the print web between the entrance and the first printing mechanism of the printing machine, between the printing mechanisms, and between the last printing mechanism and the exit or a folder are maintained also in the throughgoing passage. It is advantageous when the adjustment tolerances of all structural groups and machine elements which affect the web tensioning can be selected greater. This is because the inventive arrangement allows considerably greater web tension differences without slippage during formation of the throughgoing passage and variations resulting in a quality reduction of the print. Moreover, in accordance with the invention, the tensioning of the rubber fabric on each rubber cylinder is not influenced.

The novel features which are considered as characteristic for the present invention are set forth in particular in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figure 1:
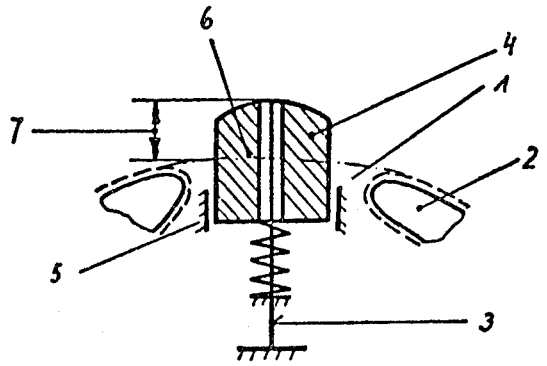
FIG. 1 is a view showing a cylinder which is provided with an inventive arrangement including a needle and does not engage with another cylinder.
Figure 2:
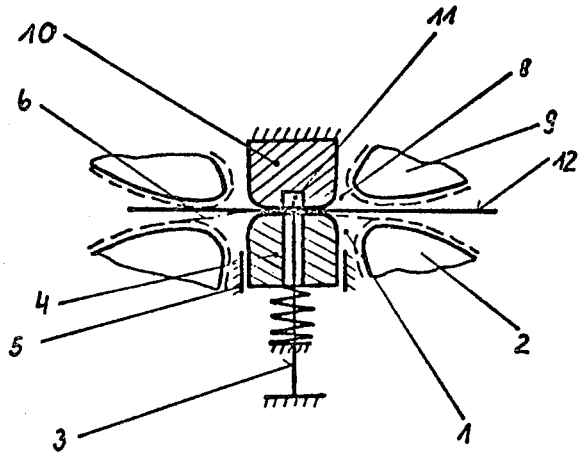
FIG. 2 is a view showing two rubber cylinders which engage one another.

An arrangement for guiding and holding a print web in a rotary printing machine having two cylinders rolling one over the other, has a needle 3 which is arranged in a passage 1 of a rubber cylinder 2. The needle 3 is arranged inside the sleeve 4 axially displaceable. The sleeve 4 is spring-biased in direction toward the outer surface of the cylinder 2 and thereby toward the web. The sleeve 4 has a top face which can coincide with the radius of the cylinder 2. A guide 5 is provided for the sleeve 4 so as to allow its guiding movement inside the guide.

As can be seen from FIG. 1, the sleeve 4 in its initial position extends outwardly beyond an outer surface 6 of the rubber cylinder 2 by a distance which corresponds the maximum functional height 7 by which the needle 3 extends outwardly beyond the outer surface 6. Thereby the sleeve 4 serves as protection against injuries.

A second cylinder 9 of the cylinder pair 2, 9 has a passage 8 in which a counter member 10 is arranged. The counter member 10 is mounted immovable. It has a radius corresponding to the radius of the cylinder 9, and a top face which lies on the outer surface 6. The counter member 10 is provided with a groove 1 whose dimensions correspond to the engagement region of the needle 3.

When the rubber cylinders 2 and 9 attain a position of formation of a throughgoing passage by the passages 1 and 8, the sleeve 4 is displaced by the counter member 10 to the outer surface 6 of the rubber cylinder 2, starting from the phase of approaching of the passages to the phase of vertical alignment of the passages 1, 8. Thereby the needle 3 engages into the print web 12 and prevents its slippage.

The functional height 7 of the needle 3 is so selected that it starts to operate before the pressure of the print web 12 by the rubber cylinders 2 and 9 is interrupted for the time of existence of the throughgoing passage, and its operation terminates after the engagement of the print web 12 by the rubber cylinders 2 and 9.

Figure 3:
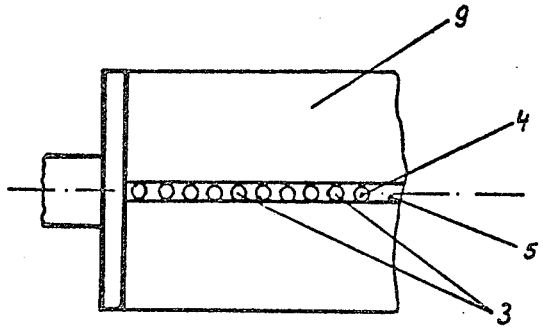
FIG. 3 is a plan view of one rubber cylinder.
Figure 4:
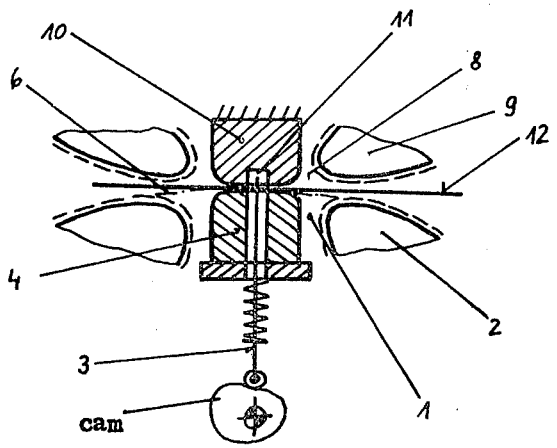
FIGS. 4 and 5 are views showing the arrangement in accordance with further embodiments of the present invention.
Figure 5:
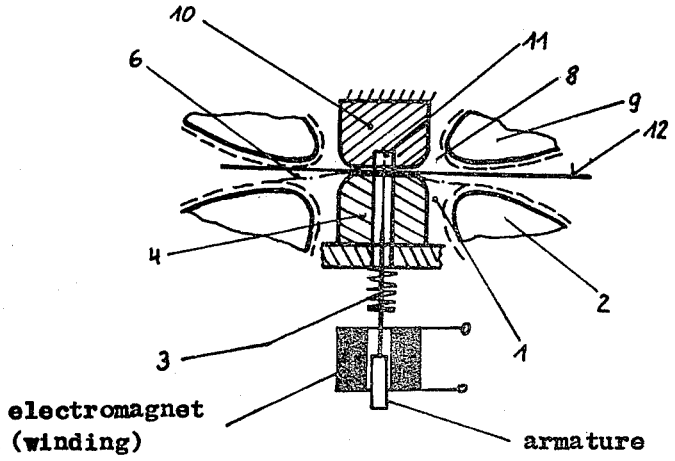
Figure 6A:
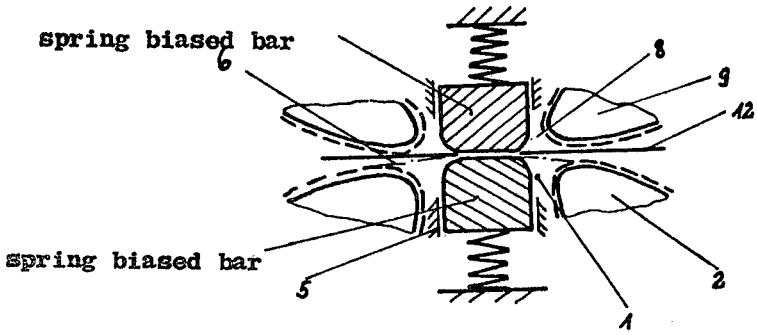
Figure 6B:
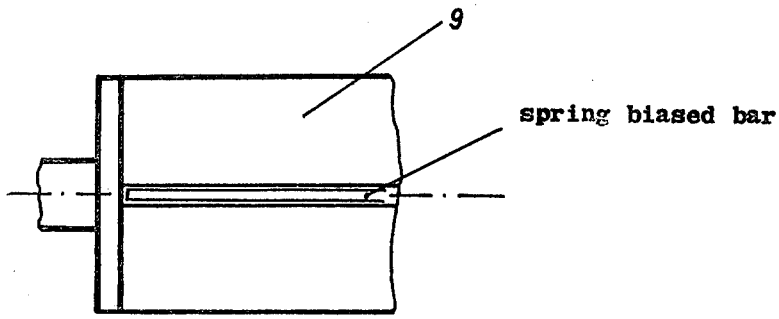
Figure 6C:
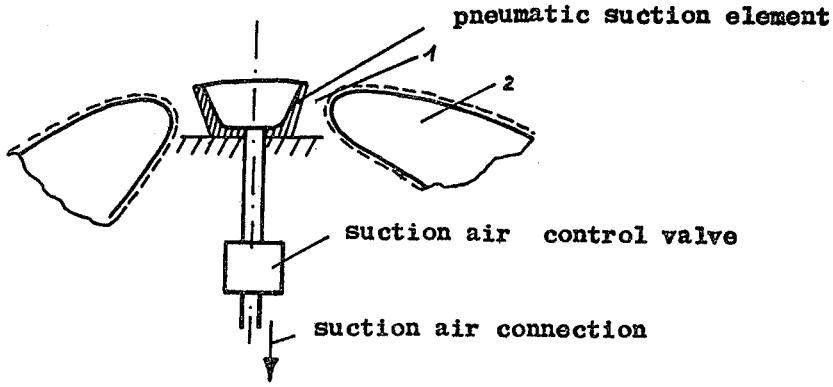

As can be seen from FIG. 3, a plurality of passages is provided in the cylinder 2, and a plurality of the needles 3 with the sleeves 4 are arranged in the passages. It is also possible to provide the passages and needles in the opposite cylinder 9. As mentioned above, the needle 3 is adjustable in direction towards the outer surface of the cylinder 2 and toward the web 12, which can be performed by adjustment means. The needle may be controlled in a rhythmic manner, particularly with respect to the start of its operation as shown in FIG. 4. The controlling means may be formed as an electromagnetically operating controlling means shown in FIG. 5, as a cam element shown in FIG. 4 and the like.

It will be understood that each of the elements described above, or two or more together, may also find a useful application in other types of constructions differing from the types described above.

While the invention has been illustrated and described as embodied in an arrangement for guiding and holding a print web in a rotary printing machine having two cylinders rolling over one another, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for guiding and holding a print web moving between cylinders of a rotary printing machine, the cylinders having outer surfaces rolling over one another, the arrangement comprising passage means including at least one longitudinal passage provided in at least one of the cylinders and being open at the outer surface of the latter; and means for preventing slippage of the web between the cylinders and including at least one element which is located in said one passage and extends at least to the outer surface of the one cylinder so as to cooperate with the print web, said element of said slippage preventing means being formed as a needle.

2. An arrangement as defined in claim 1, wherein said element is arranged to cooperate with the print web in an engaging manner.

3. An arrangement as defined in claim 1, wherein said element is arranged to cooperate with the print web in a force-transmitting manner.

4. An arrangement as defined in claim 1, wherein said element is arranged to guide the print web, during its movement.

5. An arrangement as defined in claim 1, wherein said element is arranged to hold the print web during its movement.

6. An arrangement as defined in claim 1, wherein said element is adjustable in direction toward the outer surface of the one cylinder and thereby toward the print web; and further comprising means for adjusting said element.

7. An arrangement as defined in claim 1, wherein said element is arranged to extend outwardly beyond the outer surface of the one cylinder.

8. An arrangement as defined in claim 1, wherein said passage means includes a second such passage provided in the other of the cylinders and being open at the outer surface of the latter, and said slippage preventing means including a second such element located in said second passage and extending at least to the outer surface of the other cylinder so as to cooperate with the print web.

9. An arrangement as defined in claim 1, wherein said passage means includes a plurality of such passages provided in the one cylinder, said slippage preventing means including a plurality of such elements each located in a respective one of said passages.

10. An arrangement as defined in claim 1; and further comprising means for guiding said needle, said guiding means including a sleeve which surrounds said needle and is displaceable in direction of elongation of the latter.

11. An arrangement as defined in claim 10; and further comprising means for spring biasing said sleeve and including a spring which urges said sleeve in direction toward the outer surface of the one cylinder and thereby toward the print web.

12. An arrangement as defined in claim 1 wherein said needle is controllable in a rhythmic manner; and further comprising means for controlling said needle in a rhythmic manner.

13. An arrangement as defined in claim 12, wherein said controlling means is formed as a cam element.

14. An arrangement for guiding and holding a print web moving between cylinders of a rotary printing machine, the cylinders having outer surfaces rolling over one another, the arrangement comprising passage means including at least one passage provided in at least one of the cylinders and being open at the outer surface of the latter; means for preventing slippage of the web between the cylinders and including at least one element which is located in said one passage and extends at least to the outer surface of the one cylinder so as to cooperate with the print web, said element of said slippage preventing means being formed as a needle controllable in a rhythmic manner and arranged to start functioning at a predetermined starting point; and means for controlling said needle in a rhythmic manner, said controlling means being arranged to control said starting point in a rhythmic manner.

15. An arrangement for guiding and holding a print web moving between cylinders of a rotary printing machine, the cylinders having outer surfaces rolling over one another, the arrangement comprising passage means including at least one passage provided in at least one of the cylinders and being open at the outer surface of the latter; and means for preventing slippage of the web between the cylinders and including at least one element which is located in said one passage and extends at least to the outer surface of the one cylinder so as to cooperate with the print web, said element of said slippage preventing means being formed as a needle controllable in a rhythmic manner; and means for controlling said needle in a rhythmic manner, said controlling means being electromagnetically operating controlling means.

* * * * *